US007444225B2

(12) United States Patent
Ito

(10) Patent No.: US 7,444,225 B2
(45) Date of Patent: Oct. 28, 2008

(54) ENGINE POWER CONTROLLING APPARATUS AND METHOD

(75) Inventor: Masahiro Ito, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 664 days.

(21) Appl. No.: 11/087,614

(22) Filed: Mar. 24, 2005

(65) Prior Publication Data

US 2005/0216165 A1 Sep. 29, 2005

(30) Foreign Application Priority Data

Mar. 24, 2004 (JP) ..... 2004-087257

(51) Int. Cl.
*B60T 7/12* (2006.01)

(52) U.S. Cl. ..... 701/84; 701/101

(58) Field of Classification Search ..... 701/84–87, 701/70, 99, 93, 96

See application file for complete search history.

(56) References Cited

U.S. PATENT DOCUMENTS

| | | | | |
|---|---|---|---|---|
| 5,992,382 | A | 11/1999 | Bruedigam et al. | |
| 6,704,638 | B2 * | 3/2004 | Livshiz et al. | 701/102 |
| 7,024,298 | B2 * | 4/2006 | Oohori et al. | 701/54 |
| 7,162,353 | B2 * | 1/2007 | Minowa et al. | 701/96 |
| 2002/0132701 | A1 | 9/2002 | Mabuchi et al. | |
| 2005/0107209 | A1 | 5/2005 | Nasr et al. | |

FOREIGN PATENT DOCUMENTS

| | | |
|---|---|---|
| DE | 197 08 243 C1 | 2/1997 |
| DE | 102 05 024 C1 | 7/2002 |
| EP | 1227 235 A1 | 7/2002 |
| JP | 04-051447 | 9/1993 |
| JP | 09-134585 | 12/1998 |
| JP | 2002-303177 | 10/2002 |
| JP | 2003-214231 | 7/2003 |
| JP | 2004-045344 | 2/2004 |

OTHER PUBLICATIONS

Japanese Language Version of Japanese Office Action, Appln. No. 2004-087257 dated May 29, 2007.
European Search Report dated Jul. 22, 2005.

* cited by examiner

*Primary Examiner*—Richard M. Camby
(74) *Attorney, Agent, or Firm*—Kenyon & Kenyon LLP

(57) ABSTRACT

Torque generated by the engine is obtained as engine generated torque TQe. Load torque applied to the engine is obtained as estimated engine load torque TQf. The difference between the engine generated torque TQe and the estimated engine load torque TQf is computed as estimated torque balance TQx. Torque that represents a change of the engine speed NE is computed as acceleration computation torque TQy. The difference between the estimated torque balance TQx and the acceleration computation torque TQy is computed as an estimated torque deviation TQc. The engine power is corrected based on the estimated torque deviation TQc. As a result, the responsiveness of the engine power control is improved without performing modeling as in the modern control.

10 Claims, 13 Drawing Sheets

ENGINE POWER CONTROLLING APPARATUS AND METHOD

BACKGROUND OF THE INVENTION

The present invention relates to an engine power controlling apparatus and method that control torque generated by an engine.

For example, Japanese Laid-Open Patent Publication No. 10-325348 discloses engine torque demand control, in which a target torque for idling an engine is determined based on the difference between a target engine speed and an actual engine speed, and the engine power is controlled such that the target torque is obtained.

Instead of PID control or PI control based on the engine speed as described above, Japanese Laid-Open Patent Publication No 5-248291 discloses a type of modern control in which an engine is modeled to derive an evaluation function, and the engine is controlled such that the value of the evaluation function is minimized.

The technique disclosed in the first publication includes PID control or PI control, in which engine torque is subjected to feedback control based on phenomena that actually occur in the engine speed according to adjustment of a controlled subject such as the opening degree of a throttle valve. Therefore, the adjusted amount of the engine torque does not reflect any physical basis. Therefore, it is difficult to determine the balance between the convergence property and the responsiveness through the feedback gain. Accordingly, the responsiveness to an operation for changing the torque has to be lowered.

In the technique disclosed in the second publication, the responsiveness does not need to be lowered as in the first publication. However, the manner in which the operation is performed cannot be understood intuitively, and it requires a number of steps to correct deviations between the control on the model and the control of the actual engine. Thus, the control of the second publication is not suitable for mass production.

SUMMARY OF THE INVENTION

The present invention relates to an engine power controlling apparatus and method that improve the responsiveness of an engine power control without performing modeling as in the modern control.

To achieve the foregoing and other objectives and in accordance with the purpose of the present invention, an apparatus for controlling power of an engine is provided. The apparatus includes a first computation section, a second computation section, a third computation section, and a correction section. The first computation section computes a first torque balance that represents a difference between engine generated torque, which is torque generated by the engine, and estimated engine load torque, which is load torque applied to the engine. The second computation section computes a second torque balance that represents a change of the engine speed. The third computation section computes a difference between the first torque balance and the second torque balance as a torque balance difference. The correction section corrects the engine power based on the torque balance difference.

The present invention also provides a method for controlling power of an engine. The method includes: obtaining engine generated torque that is torque generated by the engine; obtaining estimated engine load torque that is load torque applied to the engine; computing a first torque balance that represents a difference between the engine generated torque and the estimated engine load torque; computing a second torque balance that represents a change of the engine speed; computing a difference between the first torque balance and the second torque balance as a torque balance difference; and correcting the engine power based on the torque balance difference.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A first embodiment of the present invention will now be described.

Figure 1:
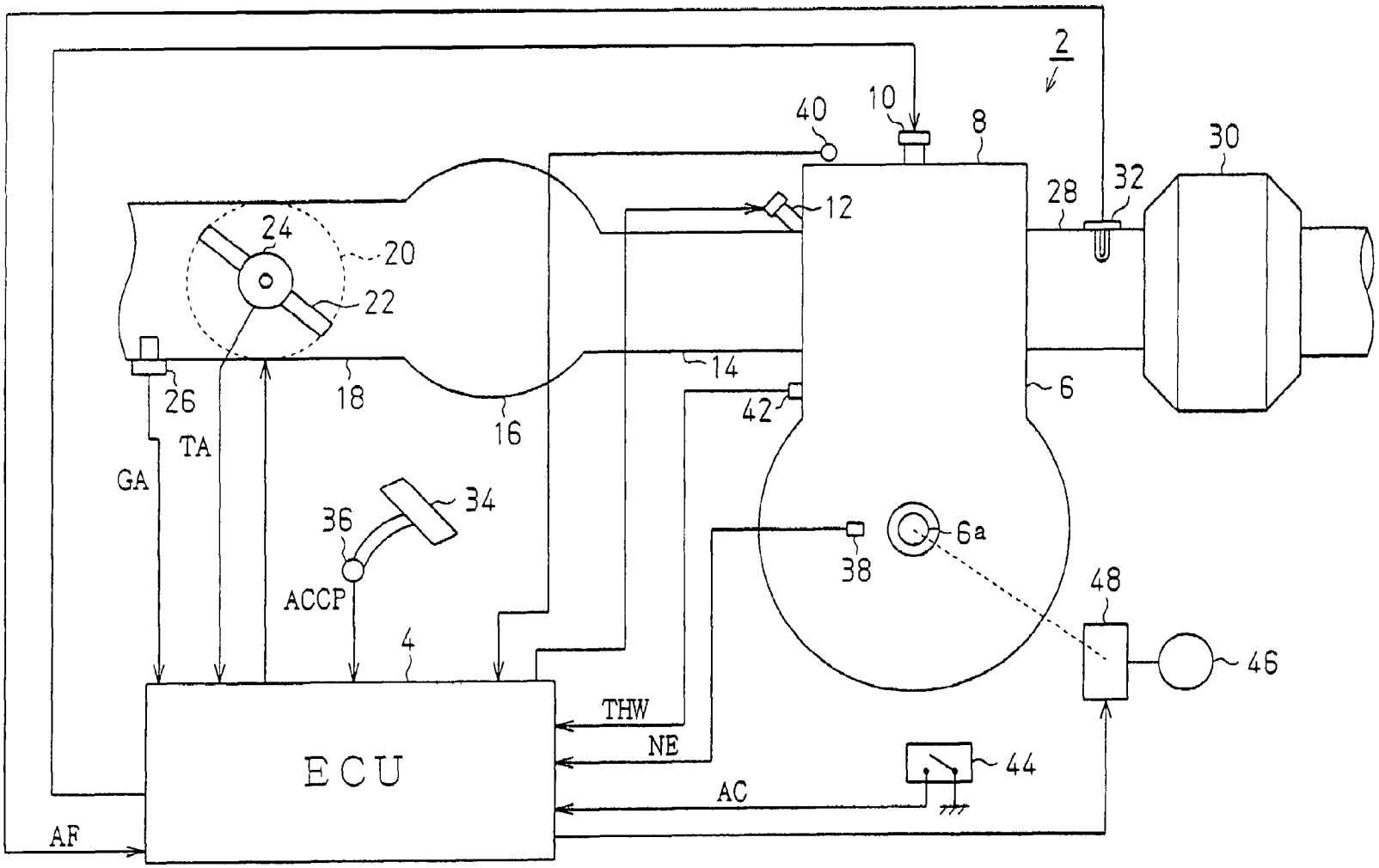
FIG. 1 is a diagrammatic view showing an engine and an ECU according to a first embodiment.

FIG. 1 is a diagram showing a gasoline engine 2, an electronic control unit (ECU) 4, which functions as a controlling apparatus. The engine 2 has a plurality of cylinders, the number of which is four in this embodiment. The engine 2 is a four-valve engine, in which each cylinder has two intake valves and two exhaust valves. The number of the cylinders may be three or more than five. Further, the present invention may be applied to a two-valve engine or a multi-valve engine having three or more valves for each cylinder.

While the vehicle is traveling, the power of the engine 2 is transmitted from a crankshaft 6*a* to wheels through a powertrain, which includes a clutch and a transmission. The engine 2 has pistons and combustion chambers. The combustion chambers are defined by a cylinder block 6 and a cylinder head 8. Ignition plugs 10 and fuel injection valves 12 are provided in the cylinder head 8. Each ignition plug 10 ignites air-fuel mixture in the corresponding combustion chamber, and each fuel injection valve 12 directly injects fuel into the corresponding combustion chamber. It may be configured that the fuel injection valves 12 inject fuel to intake ports connected to the combustion chambers.

A downstream intake passage 14 is connected to the intake ports of each cylinder. The downstream intake passages 14 are located downstream of and connected to a surge tank 16. An upstream intake passage 18 is connected to the upstream side of the surge tank 16. A throttle valve 22 is located in the upstream intake passage 18. The opening degree of the throttle valve 22, or a throttle opening degree TA, is adjusted by a motor 20. The throttle opening degree TA is controlled to adjust an intake air amount GA. The throttle opening degree TA is detected by a throttle opening degree sensor 24 and sent to the ECU 4. The intake air amount GA is detected by an intake air amount sensor 26 located upstream of the throttle valve 22, and sent to the ECU 4.

The exhaust ports connected to the combustion chambers are connected to an exhaust passage 28. An exhaust purifying catalytic converter 30 is located in the exhaust passage 28. Further, an air-fuel ratio sensor 32 is located in the exhaust passage 28. The air-fuel ratio sensor 32 detects an air-fuel ratio AF based on exhaust components in the exhaust passage 28. The detected air-fuel ratio AF is sent to the ECU 4.

The ECU 4 is an engine control circuit having a digital computer as a dominant constituent. The ECU 4 receives signals from sensors that detect the operating condition of the engine 2, other than the throttle opening degree sensor 24, the intake air amount sensor 26, and the air-fuel ratio sensor 32. Specifically, the engine ECU 4 receives signals from an acceleration pedal sensor 36, an engine speed sensor 38, and a reference crank angle sensor 40. The acceleration pedal sensor 36 detects the depression degree of an acceleration pedal 34, or an acceleration pedal depression degree ACCP. The engine speed sensor 38 detects the engine speed NE based on rotation of the crankshaft 6*a*. The reference crank angle sensor 40 determines a reference crank angle based on the rotational phase of an intake camshaft. Further, the engine ECU 4 receives signals from a coolant temperature sensor 42 that detects an engine coolant temperature THW, and an air conditioner switch 44 that is used for turning on and off the air conditioner driven by the engine 2. Other than the sensors shown above, sensors for detecting other data are provided.

Based on detection results of the connected sensors, the engine ECU 4 controls the fuel injection timing, the fuel injection amount Q, the throttle opening degree TA, and the ignition timing of the engine 2 by sending control signals to the fuel injection valves 12, the motor 20 for the throttle valve 22, and the ignition plugs 10. In this manner, the ECU 4 adjusts the engine generated torque according to the operating condition. Further, if the ECU 4 receives a signal for turning on the air conditioner from the air conditioner switch 44, the ECU 4 causes the crankshaft 6*a* and a compressor 46 for the air conditioner to be engaged with an electromagnetic clutch 48, thereby activating the air conditioner. In contrast, if the ECU 4 receives a signal for turning off the air conditioner from the air conditioner switch 44, the ECU 4 causes the electromagnetic clutch 48 to disengage, thereby stopping the air conditioner.

Figure 2:
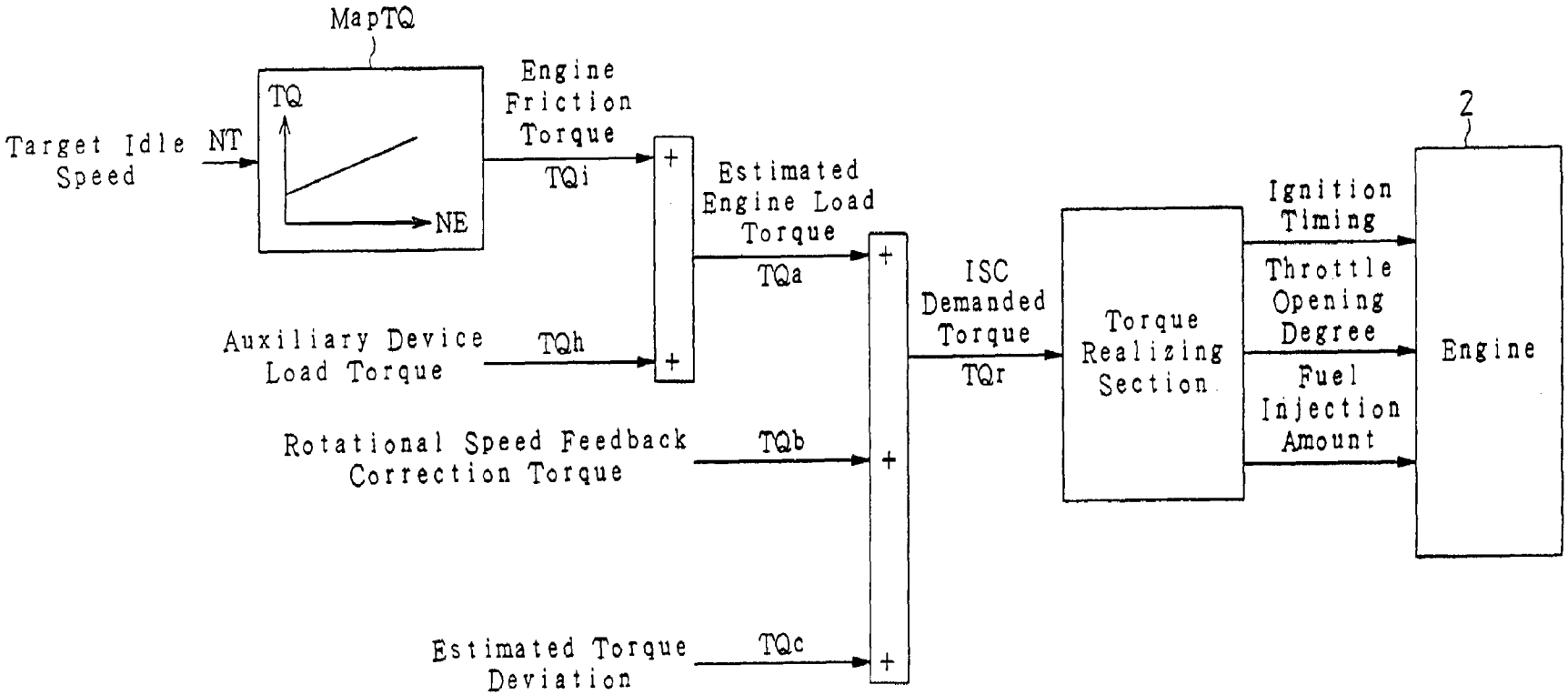
FIG. 2 is a block diagram illustrating processes of a torque control according to the first embodiment.
Figure 3:
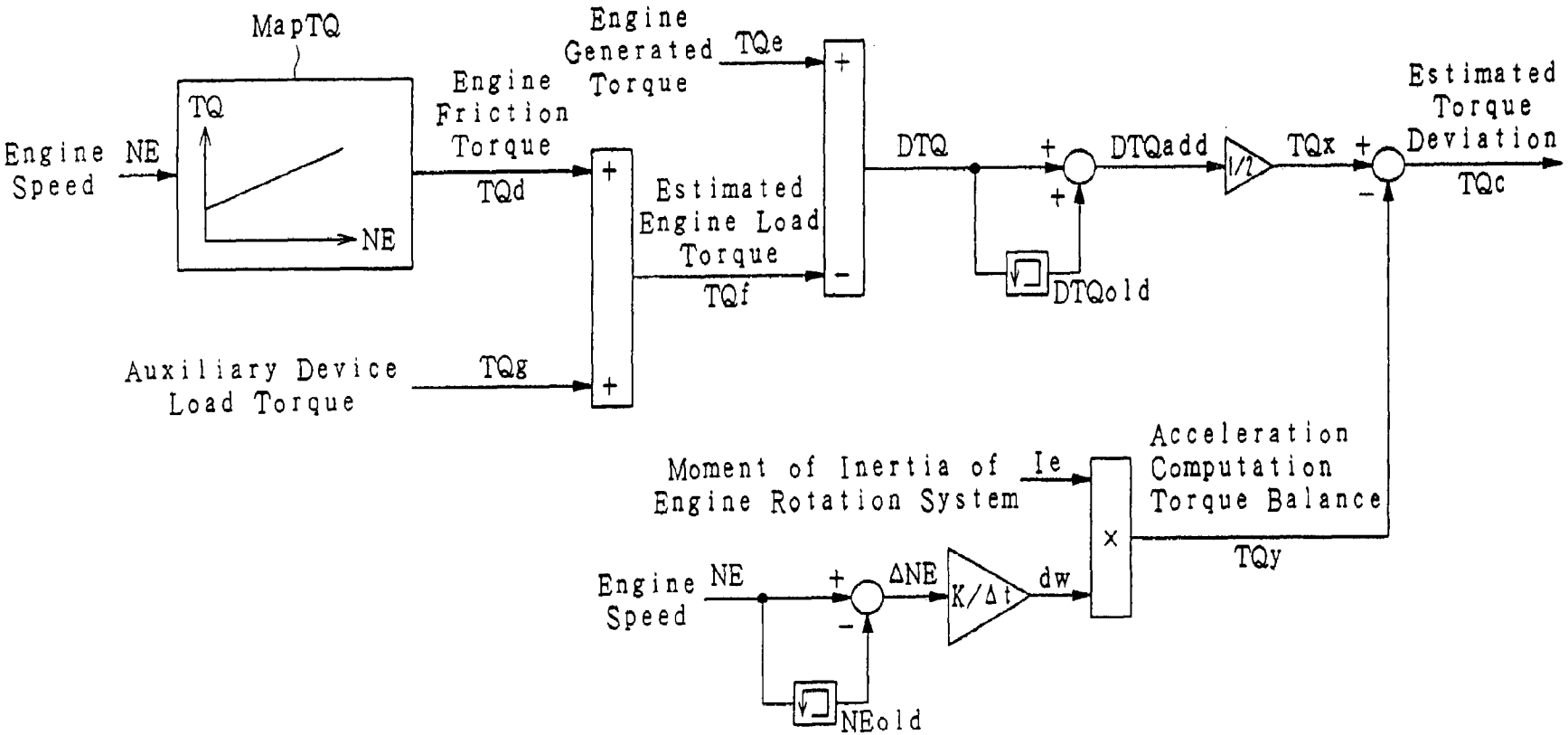
FIG. 3 is a block diagram illustrating processes of the torque control according to the first embodiment.

When the engine 2 is idling, the ECU 4 adjusts the engine generated torque TQe as illustrated in the block diagrams of FIGS. 2 and 3.

FIG. 2 will now be described. Based on a target idle speed NT, the ECU 4 obtains engine friction torque TQi corresponding to a state where the engine speed is the target idle speed NT by referring to a map MapTQ defining the relationship between the engine speed NE and the engine friction torque TQ. The engine friction torque TQ refers to load torque applied to the engine 2 due to friction produced in the engine 2. If the engine 2 is not receiving load of auxiliary devices such as the air conditioner, the target idle speed NT is set to a basic target idle speed. If any auxiliary device is being driven, a target idle speed that is greater than the basic target engine idle speed is set.

Auxiliary device load torque TQh is added to the engine friction torque TQi, and the resultant is set as estimated engine load torque TQa. The auxiliary device load torque TQh is load torque applied to the engine 2 by auxiliary devices, and corresponds to the load torque at the target idle speed NT, in this case, the load torque applied by the air conditioner. The auxiliary device load torque TQh is also set based on the target idle speed NT by referring to a map.

The estimated engine load torque TQa represents torque that acts on the engine 2 as a load resisting the rotation of the engine 2 when the engine 2 is operating at the target idle speed NT.

The sum of the estimated engine load torque TQa, a rotational speed feedback correction torque TQb, and an estimated torque deviation TQc is outputted as an ISC demanded torque TQr. The feedback correction torque TQb is set based on the difference between the target idle speed NT and the engine speed NE detected based on a signal from the engine speed sensor 38, such that the engine speed NE seeks the target idle speed NT. The estimated torque deviation TQc is shown in FIG. 3.

Then, a torque realizing section of the ECU 4 controls the ignition timing of the ignition plugs 10, the throttle opening degree TA, and the injection amount Q from the fuel injection valves 12 such that the ISC demanded torque TQr is realized.

FIG. 3 will now be described. First, based on the engine speed NE, the current engine friction torque TQd is set by referring to the map MapTQ shown in FIG. 2.

The auxiliary device load torque TQg is added to the engine friction torque TQd, and the resultant is set as estimated engine load torque TQf. The auxiliary device load torque TQg corresponds to the load torque applied to the engine 2 by the auxiliary devices at the current engine speed NE. The auxiliary device load torque TQg is set based on the actual engine speed NE by referring to the same map as that used for obtaining the auxiliary device load torque TQh.

The estimated engine load torque TQf represents torque that acts on the engine 2 as a load resisting the rotation of the engine 2, which is operating at the current engine speed NE.

Then, the estimated engine load torque TQf is subtracted from the engine generated torque TQe, and the resultant is set as a torque difference DTQ. The engine generated torque TQe may be obtained by actually detecting the output torque of the engine 2 with a torque sensor, by computing torque according to a mean effective pressure based on the combustion pressure detected by a combustion pressure sensor, or by referring to a map that has been set in advance through experiments where the engine speed NE and the fuel injection amount Q are used as parameters. In this embodiment, the engine generated torque TQe is obtained based on the engine speed NE and the fuel injection amount Q by referring to a map.

The torque difference DTQ is added to a torque difference DTQold, which was obtained in the previous control cycle. The resultant is set as a total torque DTQadd. The total torque DTQadd is halved, and the resultant is set as an estimated torque balance TQx (first torque balance).

On the other hand, a previous engine speed NEold, which was obtained in the previous control cycle, is subtracted from the engine speed NE, and the resultant is set as an engine speed change ΔNE. The engine speed change ΔNE is divided by a control cycle Δt. The resultant is multiplied by a conversion factor K to obtain an angular acceleration dw (rad/s) of the crankshaft 6*a*. The angular acceleration dw is multiplied by the moment of inertia Ie of the engine rotation system that includes the engine 2 and the auxiliary devices driven by the engine 2, which moment of inertia Ie is obtained in advance. The resultant is set as an acceleration computation torque balance TQy (corresponding to a second torque balance).

The acceleration computation torque balance TQy is subtracted from the estimated torque balance TQx, and the resultant is set as the torque deviation TQc.

Then, the estimated engine load torque TQa and the feedback correction torque TQb are added to the estimated torque deviation TQc as shown in FIG. 2 to obtain the ISC demanded torque TQr.

When setting the estimated torque balance TQx, the total torque DTQadd, which is the sum of the torque difference DTQ and the torque difference DTQold of the previous control cycle is halved for the following reasons.

Figure 4:
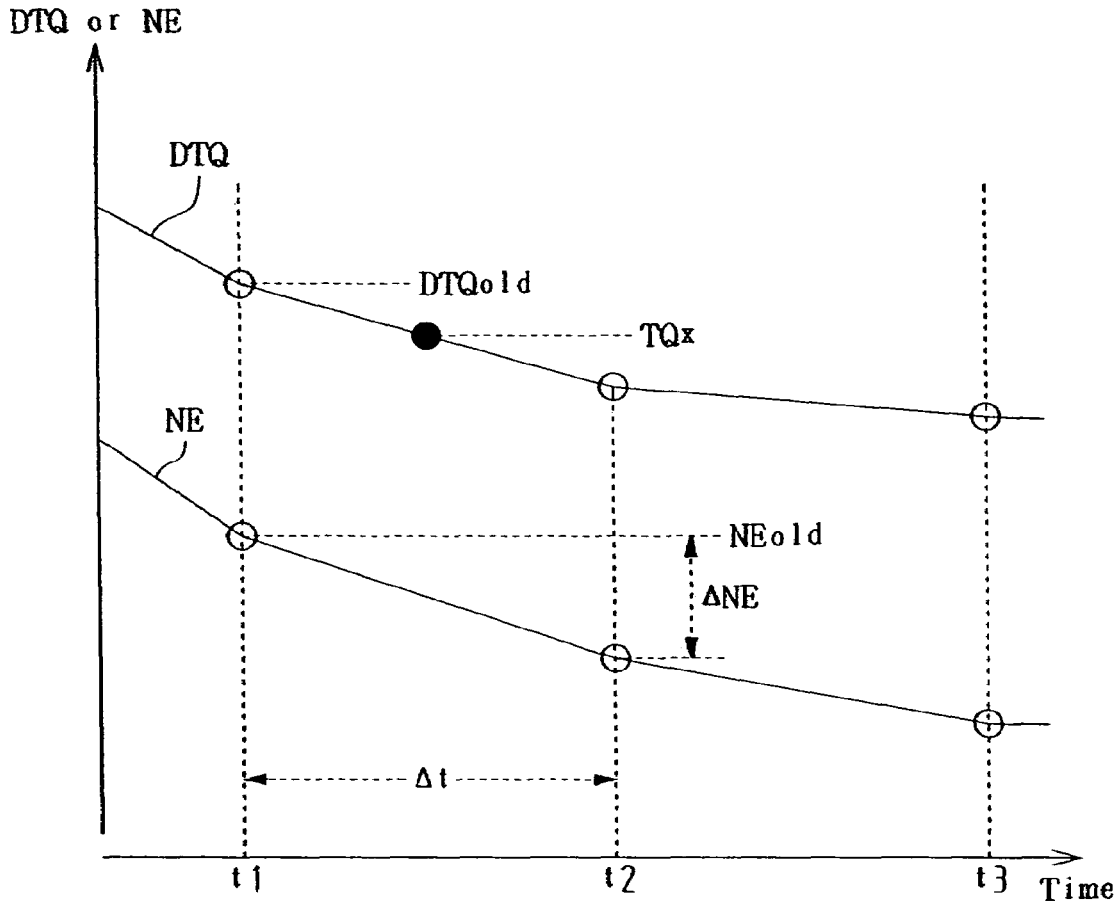
FIG. 4 is a graph showing synchronization of an estimated torque balance TQx and an acceleration computation torque balance TQy according to the first embodiment.

As shown in FIG. 4, the control is executed at points in time t1, t2, and t3 at an interval of a control cycle Δt. In the computation at the point in time t2, the engine speed change ΔNE, which is used for obtaining the acceleration computation torque balance TQy, is obtained by subtracting the previous engine speed NEold at the preceding execution point in time t1 from the engine speed NE at the execution point in time t2. Therefore, the acceleration computation torque balance TQy, which is computed based on the engine speed change ΔNE, the control cycle Δt, the conversion factor K, and the moment of inertia Ie, is an average value of two values of acceleration at the execution point in time t1 and the execution point in time t2. Thus, as the estimated torque balance TQx, from which the acceleration computation torque balance TQy is subtracted, an average value between the torque difference DTQold at the execution point in time t1 and the torque difference DTQ at the execution point in time t2 is used.

Figure 5:
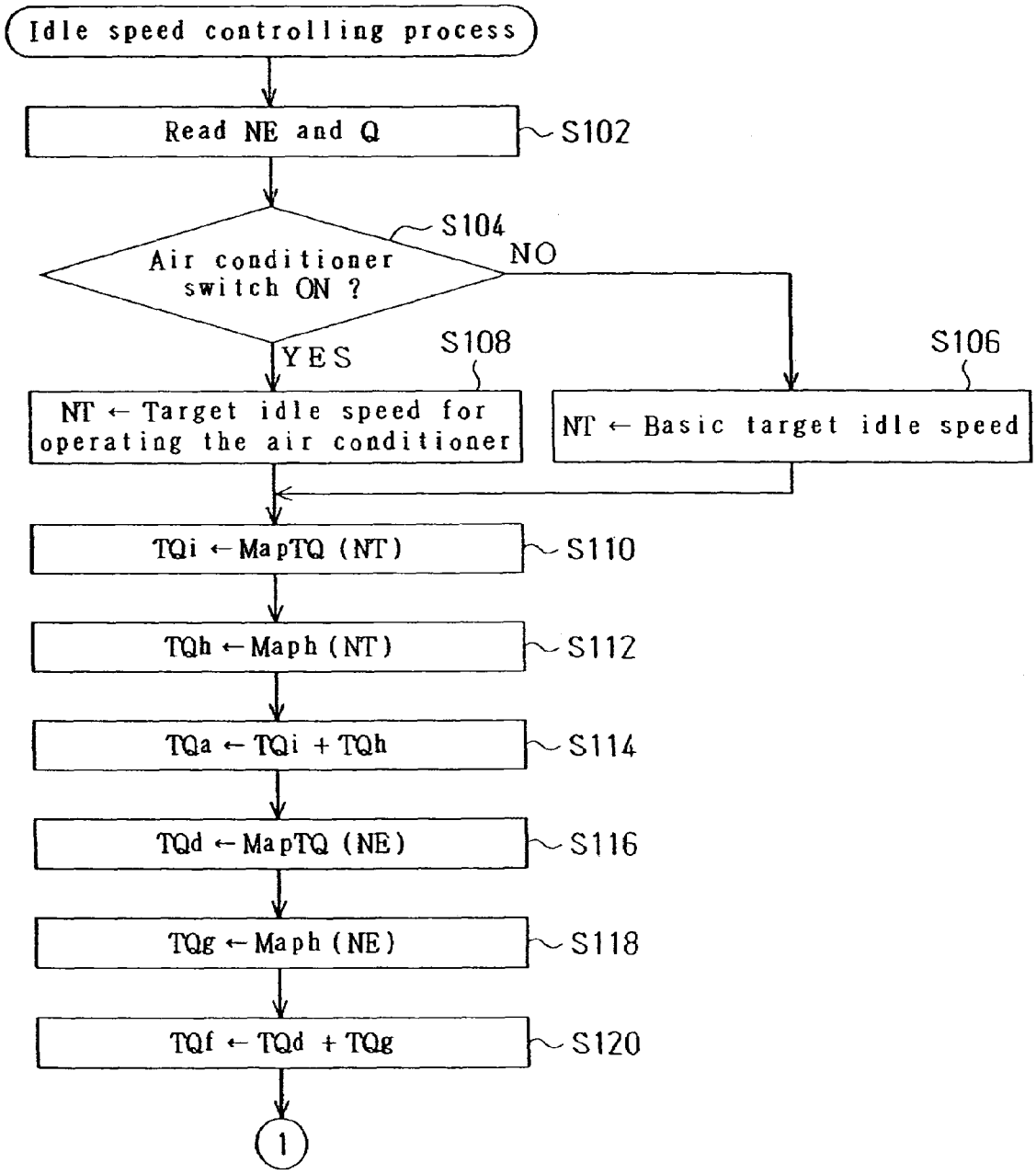
FIG. 5 is a flowchart showing an idle speed controlling process executed by the ECU according to the first embodiment.
Figure 6:
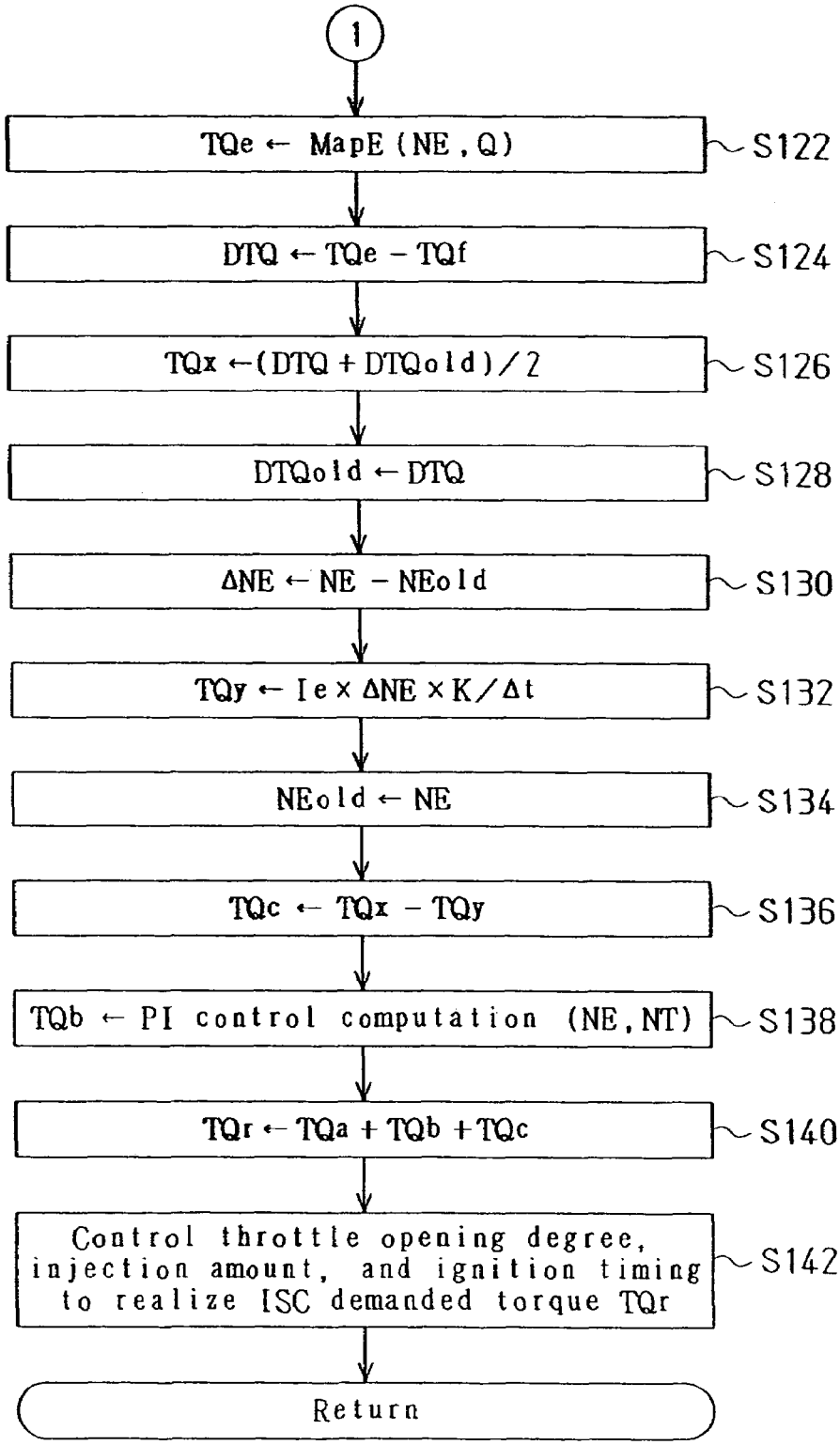
FIG. 6 is also a flowchart showing the idle speed controlling process.

An example of flowcharts of the idle speed controlling process is shown in FIGS. 5 and 6. The flowcharts of FIGS. 5 and 6 correspond to the block diagrams of FIGS. 2 and 3. This process is repeatedly executed while the engine 2 is idling, or when the throttle opening degree TA is 0%, at a predetermined interval, which corresponds to the control cycle Δt in this embodiment. Steps in the flowchart, each of which corresponds to a process, is denoted as S.

First, the engine speed NE detected based on a signal from the engine speed sensor 38, and the injection amount Q of fuel injected from the fuel injection valves 12 are read into a working storage of memory provided in the ECU 4 (S102). Then, whether the air conditioner switch 44 is ON or OFF is determined (S104).

If the air conditioner switch 44 is OFF, or if the outcome at S104 is negative, the value of the basic target idle speed is set as the target idle speed NT (S106). On the other hand, if the air conditioner switch 44 is ON, or if the outcome at S104 is positive, the value of a target idle speed for operating the air conditioner is set as the target idle speed NT (S108).

At step 110, the engine friction torque TQi is computed based on the target idle speed NT by referring to the map MapTQ.

At step 112, the auxiliary device load torque TQh is computed based on the target idle speed NT by referring to a map Maph. The map Maph is selected from a set of maps depending on the types and number of auxiliary devices that are currently driven by the engine 2. If no auxiliary device is currently driven, the auxiliary device load torque TQh is zero.

As shown in the following expression 1, the auxiliary device load torque TQh is added to the engine friction torque TQi, and the resultant is set as the estimated engine load torque TQa (S114).

$$TQa \leftarrow TQi + TQh \quad \text{[Expression 1]}$$

At step 116, the engine friction torque TQd is computed based on the engine speed NE by referring to the map MapTQ.

Further, at step 118, the auxiliary device load torque TQg is computed based on the engine speed NE by referring to the map Maph. The map Maph is configured as discussed in the above description of step S112. If no auxiliary device is currently driven, the auxiliary load torque TQg is zero.

As shown in the following expression 2, the auxiliary device load torque TQg is added to the engine friction torque TQd, and the resultant is set as the estimated engine load torque TQf (S120).

$$TQf \leftarrow TQd + TQg \quad \text{[Expression 2]}$$

Next, the engine generated torque TQe is obtained based on the engine speed NE and the fuel injection amount Q, by referring to a map MapE (S122). Then, as shown in the following expression 3, the estimated engine load torque TQf is subtracted from the engine generated torque TQe, and the resultant is set as the torque difference DTQ (S124).

$$DTQ \leftarrow TQe - TQf \quad \text{[Expression 3]}$$

The estimated torque balance TQx is computed using the following expression 4 (S126).

$$TQx \leftarrow (DTQ + DTQold)/2 \quad \text{[Expression 4]}$$

The previous torque difference DTQold in the right side of the expression 4 is the torque difference DTQ in the previous control cycle.

Then, the torque difference DTQ is set as the previous torque difference DTQold (S128).

The engine speed change ΔNE is computed using the following expression 5 (S130).

$$\Delta NE \leftarrow NE - NEold \quad \text{[Expression 5]}$$

The previous engine speed NEold in the right side of the expression 5 is the engine speed NE in the previous control cycle.

Then, the acceleration computation torque balance TQy is computed based on the engine speed change ΔNE, the moment of inertia Ie, the conversion factor K, and the control cycle Δt, as shown in the following expression 6 (S132).

$$TQy \leftarrow Ie \times \Delta NE \times K/\Delta t \quad \text{[Expression 6]}$$

Then, the engine speed NE is set as the previous engine speed NEold (S134).

The estimated torque deviation TQc is computed using the following expression 7 (S136).

$$TQc \leftarrow TQx - TQy \quad \text{[Expression 7]}$$

Next, based on the difference between the engine speed NE and the target idle speed NT, the feedback correction torque TQb is computed through PI control computation.

The ISC demanded torque TQr is computed using the following expression 8 (S140).

$$TQr \leftarrow TQa + TQb + TQc \quad \text{[Expression 8]}$$

The throttle opening degree TA of the throttle valve 22, the injection amount Q of the fuel injection valves 12, and the ignition timing of the ignition plugs 10 are controlled such that the ISC demanded torque TQr is realized (S142).

Figure 7:
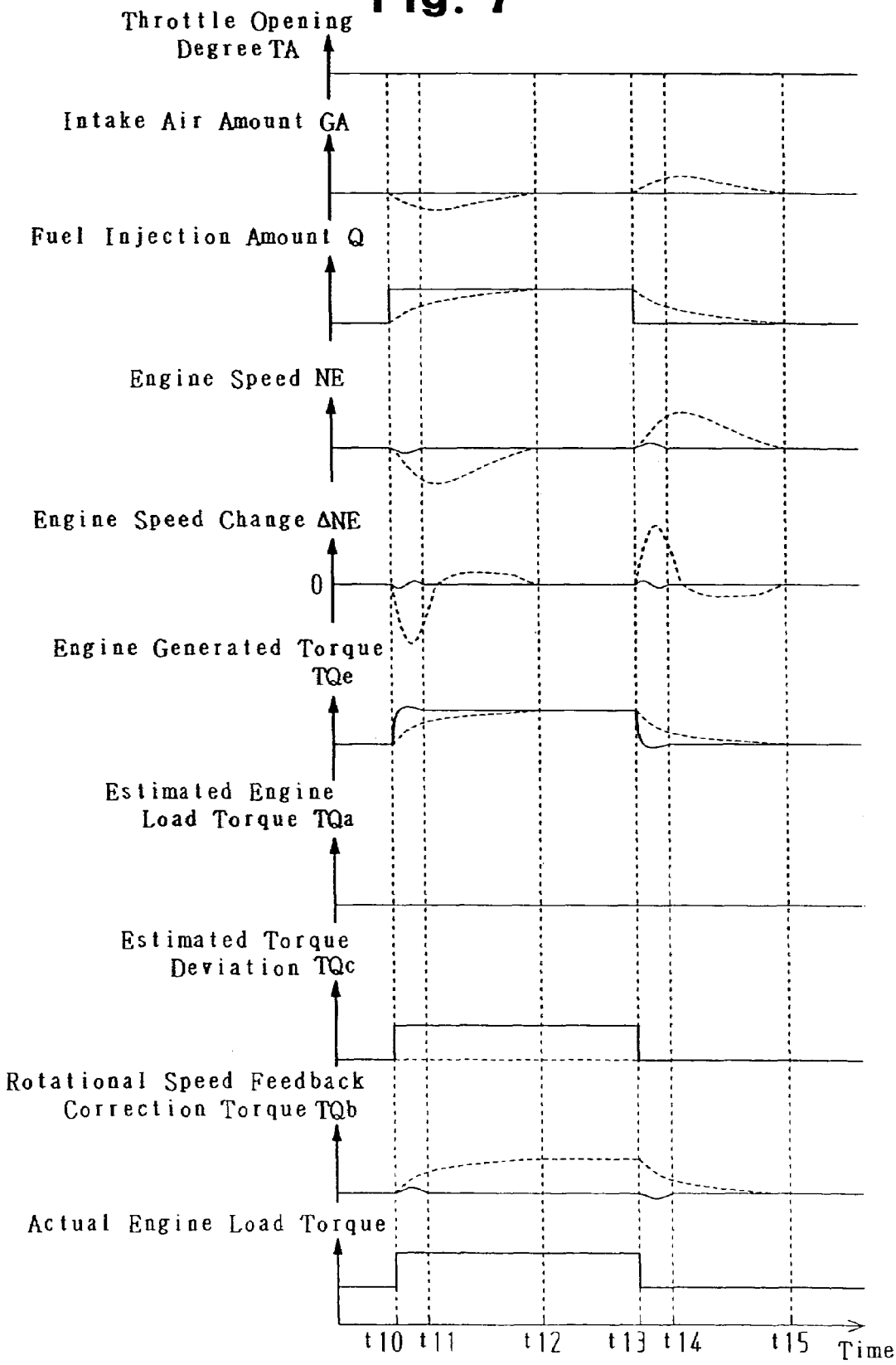
FIG. 7 is a timing chart showing an example of the control according to the first embodiment.

One example of the process according to this embodiment is shown in the timing chart of FIG. 7. A case will be described in which an unexpected load discretely occurs in the system while the engine 2 is idling. In this embodiment, in respond to an abrupt drop of the engine speed change ΔNE immediately after a point in time t10, the acceleration computation torque balance TQy is shifted to the negative region discretely. Thus, the estimated torque deviation TQc is increased immediately according to the expression 7 to quickly and accurately represent the actual increase of the engine load torque. Therefore, the ISC demanded torque TQr is increased discretely according to the expression 8.

In the example of FIG. 7, when the engine 2 is idling, the system sets the throttle opening degree TA to a degree that corresponds to the load of the idling state, and controls the engine generated torque TQe by adjusting the injection amount Q from the fuel injection valves 12. Therefore, the injection amount Q is increased discretely in accordance with the discrete increase of the ISC demanded torque TQr, which quickly increases the engine generated torque TQe to a required level.

Since the engine generated torque TQe is quickly increased, the estimated torque balance TQx is increased. Thus, even if the acceleration computation torque balance TQy approaches zero from the negative region due to an increase of the engine speed change ΔNE, the estimated torque deviation TQc is not decreased. Therefore, if the engine speed NE is unstable immediately after an unexpected load has been increased discretely, the estimated torque deviation TQc is maintained at a level that corresponds to the unexpected load (t10 to t11). Then, after the engine speed NE is stabilized (from t11), the estimated torque deviation TQc is maintained to the level corresponding to the unexpected load. This permits the idling of the engine 2 to continue to be stably controlled. That is, a highly responsive engine power control is performed.

Contrarily, in the prior art, the degree by which the engine speed NE is lowered below the target idle speed NT is obtained, and the obtained degree is reflected on the engine generated torque TQe. In the prior art system, when the load is unexpectedly and discretely increased, the discretely increased amount of load cannot be immediately reflected on the fuel injection amount Q because of the setting of the balance between the convergence property and the responsiveness. The engine generated torque TQe therefore cannot be rapidly increased, and it takes longer time for the engine speed NE to be stabilized as indicated by broken lines (t10 to t12). That is, the responsiveness of the engine power control cannot be improved only by the prior art rotational speed feedback control.

The unexpected load discretely vanishes at a point in time t13. In this embodiment, in respond to an abrupt increase of the engine speed change ΔNE immediately after the point in time t13, the acceleration computation torque balance TQy is shifted to the positive region discretely. Thus, the estimated torque deviation TQc is decreased immediately according to the expression 7 to quickly and accurately represent the disappearance of the engine load torque. Therefore, the ISC demanded torque TQr is immediately and discretely decreased according to the expression 8. Accordingly, the fuel injection amount Q is decreased discretely, which quickly decreases the engine generated torque TQe to a required level.

Since the engine generated torque TQe is quickly decreased, the estimated torque balance TQx is decreased. Thus, even if the acceleration computation torque balance TQy approaches zero from the positive region due to a decrease of the engine speed change ΔNE, the estimated torque deviation TQc is not increased. Therefore, if the engine speed NE is unstable immediately after an unexpected load has vanished discretely, the estimated torque deviation TQc is maintained at a level that corresponds to the eliminated load (t13 to t14). Then, after the engine speed NE is stabilized (from t14), the estimated torque deviation TQc is maintained to the level corresponding to a state after the unexpected load disappears. This permits the idling of the engine 2 to continue to be stably controlled. That is, a highly responsive engine power control is performed.

Contrarily, in the prior art, the degree by which the engine speed NE is increased higher than the target idle speed NT is obtained, and the obtained degree is reflected on the engine generated torque TQe. In the prior art system, when an unexpected load discretely vanishes, the discretely decreased amount of the load cannot be immediately reflected on the fuel injection amount Q because of the setting of the balance between the convergence property and the responsiveness. The engine generated torque TQe therefore cannot be rapidly decreased, and it takes longer time for the engine speed NE to be stabilized as indicated by a broken line (t13 to t15). That is, the responsiveness of the engine power control cannot be improved only by the prior art rotational speed feedback control.

In this embodiment, since the engine speed NE is caused to converge to the target idle speed NT, the feedback correction torque TQb is computed separately. However, the feedback correction torque TQb is designed to compensate for the estimated torque deviation TQc, and has little effect on the control.

FIG. 7 shows an example in which an unexpected load discretely occurs or vanishes. However, even if an unexpected load gradually occurs or vanishes, the present embodiment is capable of improving the responsiveness of the control to changes of the load, unlike the prior art, which has a lower responsiveness.

In the above described configuration, steps S116 to S128 of the idle speed controlling process (FIGS. 5 and 6) correspond to a first computation section, steps S130 to S134 correspond to a second computation section. Step S136 corresponds to a third computation section, and step S140 corresponds to a correction section.

The first embodiment described above has the following advantages.

(A) The estimated torque balance TQx, which is the difference between the engine generated torque TQe and the estimated engine load torque TQf, acts on the engine 2 to change the engine speed NE. The acceleration computation torque balance TQy, which represents a change of the engine speed NE, is torque that is affected by the engine rotation.

Therefore, if the estimated torque balance TQx and the acceleration computation torque balance TQy are different, the estimated torque deviation TQc (corresponding to the torque balance difference) is regarded to represent the difference between the estimated engine load torque TQa used for controlling the engine power and the actual engine load torque.

Therefore, by correcting the engine power based on the estimated torque deviation TQc (S140), the state of the engine power is shifted to a more appropriate state.

Also, since the engine power is corrected by the estimated torque deviation TQc, which has been obtained using a physical basis, the convergence property and the responsiveness do not need to be balanced by using a feedback gain. This permits the engine power to be highly responsive to load fluctuations.

In this manner, a high responsive engine power control is possible without performing modeling of the modern control.

(B) The engine generated torque TQe is obtained based on the engine operating condition. Specifically, the engine generated torque TQe is obtained through estimation based on the engine speed NE and the fuel injection amount Q. Thus, the engine control is easily executed without providing torque sensors and engine combustion pressure sensors.

(C) The estimated engine load torque TQf represents the load torque of the engine friction and the load torque of the auxiliary devices, which act to resist rotation of the engine 2. Therefore, the engine friction torque TQd is obtained based on the engine speed NE by referring the map MapTQ (S116), and the auxiliary device load torque TQg is obtained based on the engine speed NE by referring to the Maph, which corresponds to the types and the number of the auxiliary devices (S118).

In this manner, the estimated engine load torque TQf is easily computed based on the engine speed NE. Accordingly, the above described engine control is easily performed.

(D) The acceleration computation balance TQy is also easily obtained based on the engine speed NE (S130, S132). Thus, the engine control described above is easily performed.

(E) As in the expression 6, the engine speed change ΔNE for computing the acceleration computation torque balance TQy, corresponds to an average value of acceleration in a period that approximately corresponds to the control cycle Δt.

Therefore, the estimated torque balance TQx is not exactly equal to the torque difference DTQ between the engine generated torque TQe and the estimated engine load torque TQf in each control cycle, but is an average value of the two torque differences DTQ and DTQold obtained at an interval approximately corresponding to the control cycle Δt. Accordingly, a time lag between the estimated torque balance TQx and the acceleration computation torque balance TQy is eliminated. This further improves the accuracy of the engine power control.

A second embodiment of the present invention will now be described.

In this embodiment, the present invention is also applied to states of the engine 2 other than the idling state. In this embodiment, the ECU 4 performs the idle speed control process (FIGS. 2, 3, 5 and 6) as in the first embodiment when the engine 2 is idling. When the engine 2 is not idling, the ECU 4 adjusts the engine generated torque TQe as illustrated in the block diagrams of FIGS. 8 and 9. Thus, FIGS. 1 to 6 are referred to as necessary in the following description. Also, the engine 2 and the vehicle have a shift sensor, a vehicle speed sensor, a vehicle weight sensor, and a road inclination sensor. The ECU 4 detects the shift state of the transmission, the vehicle speed, the vehicle acceleration, the weight of the vehicle including the passengers, and the road inclination. Further, a torque sensor is provided between the crankshaft 6*a* and the clutch to detect a load of a transmission system, or a powertrain load torque TQv. The powertrain load torque TQv is load torque applied to the engine 2 by the powertrain.

Figure 8:
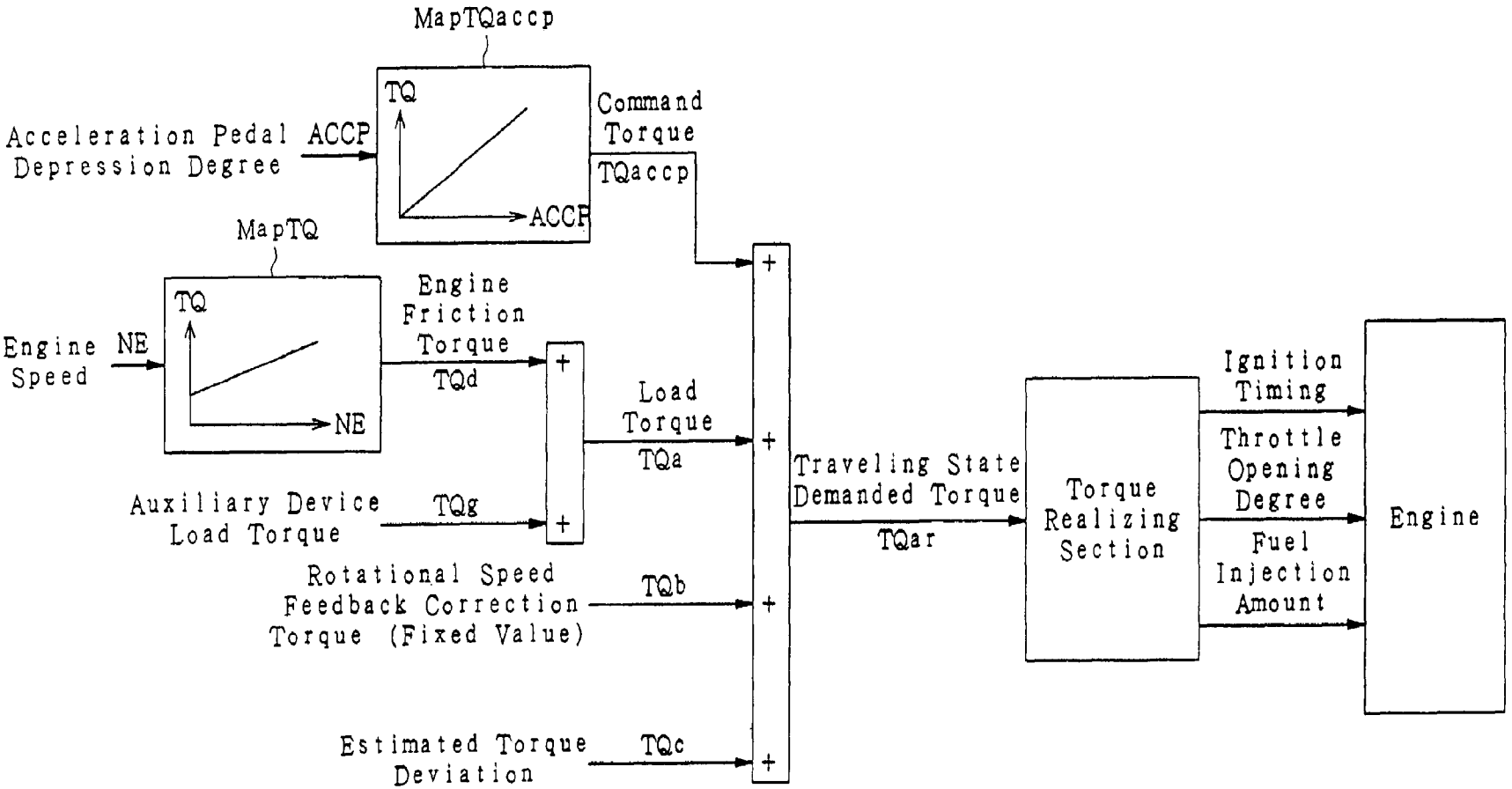
FIG. 8 is a block diagram illustrating processes of a torque control according to a second embodiment.

FIG. 8 will now be described. The ECU 4 first obtains a command torque TQaccp based on the acceleration pedal depression degree ACCP detected by the acceleration pedal sensor 36, by referring to a map MapTQaccp, which defines the relationship between the acceleration pedal depression degree ACCP and the command torque TQaccp. The map MapTQaccp is designed such that acceleration pedal depression degree ACCP and the command torque TQaccp are substantially proportionate to each other.

Then, based on the engine speed NE detected by the engine speed sensor 38, the engine friction torque TQd corresponding to the detected engine speed NE is computed by referring to the map MapTQ described in the first embodiment. The auxiliary device load torque TQg is added to the engine friction torque TQd, and the resultant is set as a load torque TQa. The auxiliary device load torque TQg is described in the first embodiment. However, in the second embodiment the auxiliary device load torque TQg is obtained based on the engine speed NE by referring the map Maph.

The sum of the command torque TQaccp, the load torque TQa, the feedback correction torque TQb, and the estimated torque deviation TQc is outputted as a traveling state demanded torque TQar. In the first embodiment, when the engine 2 is idling, a correction torque is computed for causing the engine speed NE to seek the target idle speed NT. This correction torque is set as a fixed value (learning value) and used as the feedback correction torque TQb in the second embodiment.

Then, a torque realizing section of the ECU 4 controls the ignition timing of the ignition plugs 10, the throttle opening degree TA of the throttle valve 22, and the injection amount Q from the fuel injection valves 12 such that the engine 2 generates the traveling state demanded torque TQar.

Figure 9:
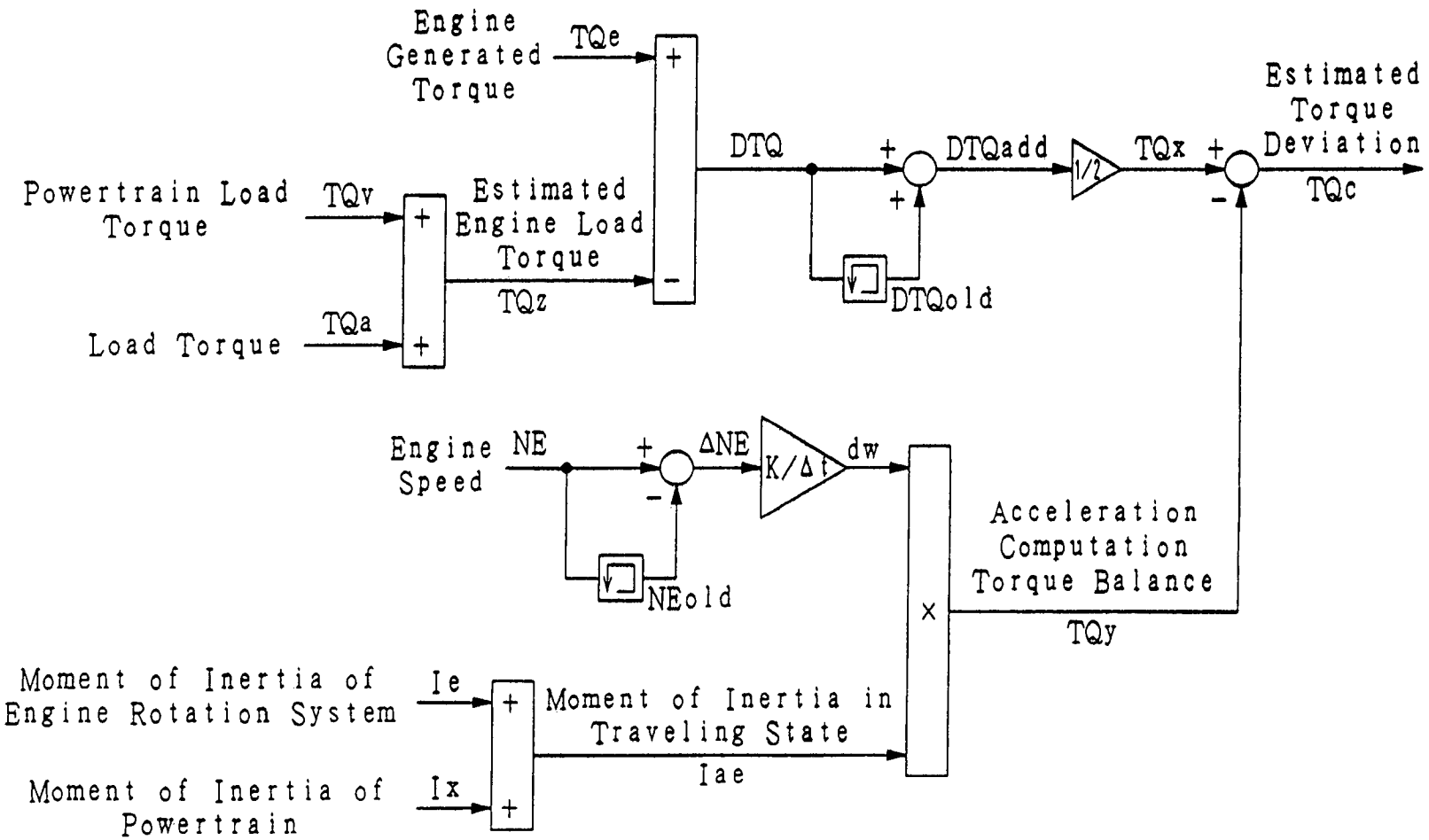
FIG. 9 is a block diagram illustrating processes of the torque control according to the second embodiment.

The estimated torque deviation TQc will now be described with reference to FIG. 9. Estimated engine load TQz is subtracted from the engine generated torque TQe, which is computed in the manner described in the first embodiment, and the resultant is set as a torque difference DTQ. The estimated torque balance TQx is computed from the torque difference DTQ in the manner described in the first embodiment.

The estimated engine load torque TQz is the sum of the powertrain load torque TQv and the load torque TQa shown in FIG. 8 (TQz=TQd+TQg). The powertrain load torque TQv is a load torque transmitted from the powertrain to the crankshaft 6*a*, and is actually detected by the torque sensor provided between the crankshaft 6*a* and the clutch. Instead of detecting the powertrain load torque TQv with such a torque sensor, the powertrain load torque TQv may be obtained in the following manner. That is, the vehicle acceleration, the weight of the vehicle including the passengers, the shift state of the transmission, the running resistance according to the vehicle speed, and the angle of inclination of the road may be detected by the above sensors, and based on the detected data, the powertrain load torque TQv may be obtained by referring to a torque map for the powertrain load.

The computations of the engine speed NE and the angular acceleration dw are executed in the same manner as described in the first embodiment.

Further, a moment of inertia Iae in the traveling state is obtained by adding the moment of inertia Ie of the engine rotation system and a moment of inertia Ix of the powertrain. The moment of inertia Ix of the powertrain refers to a moment of inertia that is generated by the weight of the vehicle including the passengers, the shift state of the transmission, the vehicle traveling resistance according to the vehicle speed, and the inclination angle of the road. The value of the moment of inertial Ix is computed based on the detection values of the vehicle weight sensor, the shift sensor, the vehicle speed sensor, and the road inclination sensor by referring to a moment of inertia map. For example, a moment of inertia in the traveling state that is related to the vehicle weight is obtained based on the vehicle weight M, the shift position SFT, and the road inclination angle α by referring to a map Mapmst. Further, a moment of inertia in the traveling state that is related to the speed, such as the vehicle traveling resistance, based on the vehicle speed SPD by referring to a map Mapspd. The sum of the moments of inertia is set as the moment of inertia Ix of the powertrain.

The moment of inertia Iae in the traveling state is multiplied by the angular velocity dw to compute the acceleration computation torque balance TQy.

As in the first embodiment, the acceleration computation torque balance TQy is subtracted from the estimated torque balance TQx, and the resultant is set as the torque deviation TQc.

The command torque TQaccp, the load torque TQa, and the feedback correction torque TQb are added to the estimated torque deviation TQc as shown in FIG. 8 to obtain the traveling state demanded torque TQar.

Figure 10:
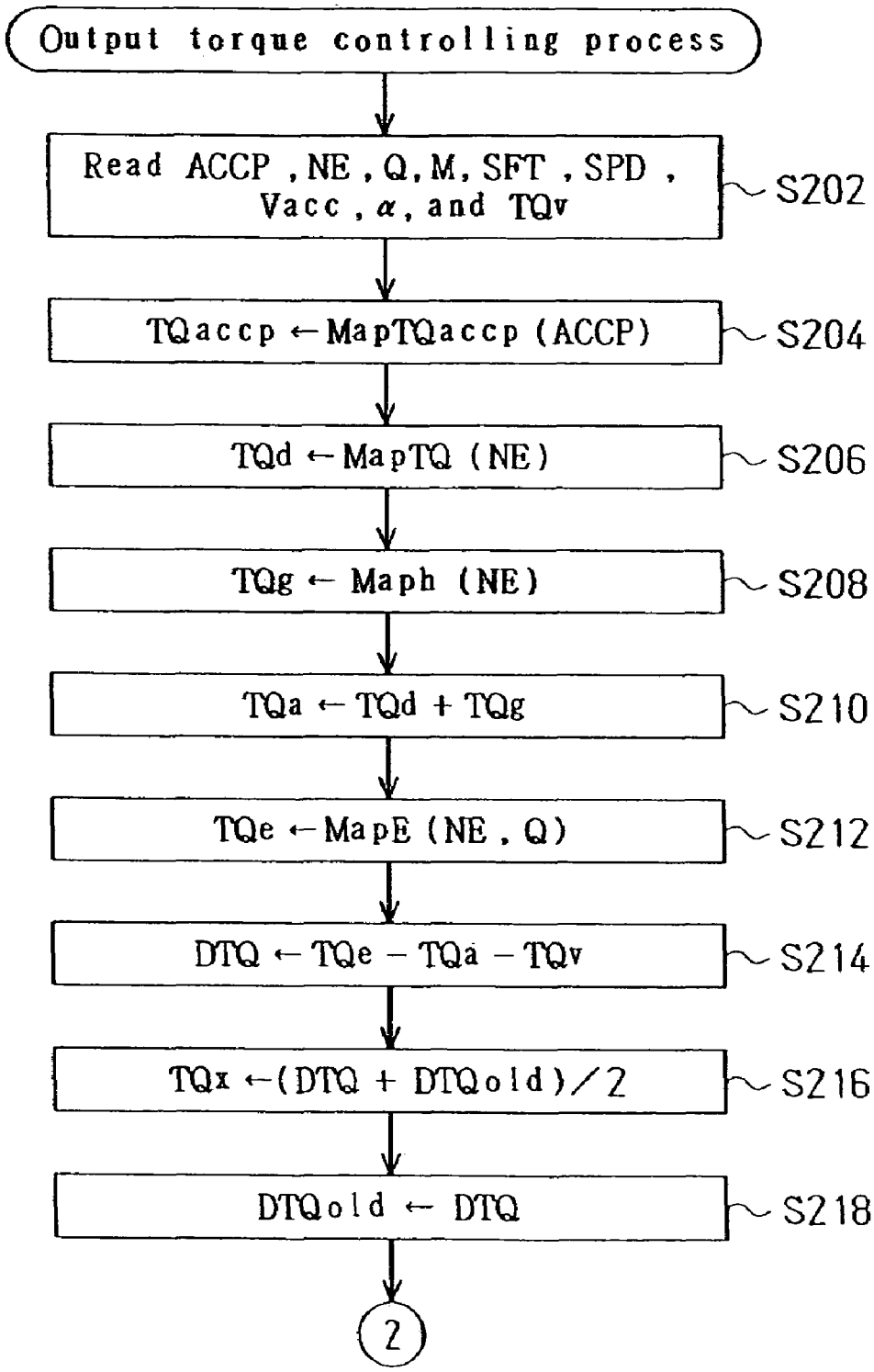
FIG. 10 is a flowchart showing an output torque controlling process executed by the ECU according to the second embodiment.
Figure 11:
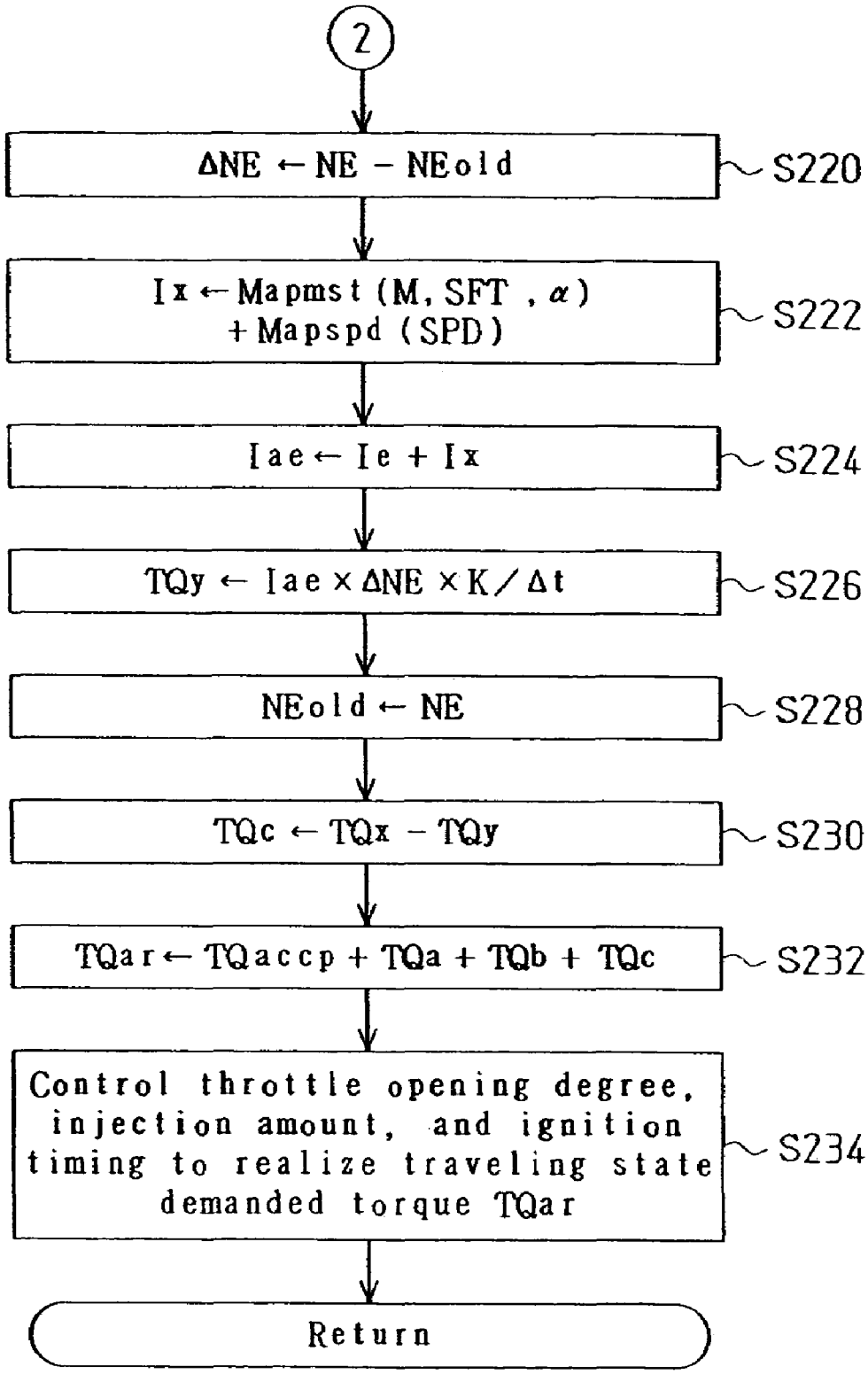
FIG. 11 is also a flowchart showing the output torque controlling process.

An example of flowcharts of the output torque controlling process is shown in FIGS. 10 and 11. The flowcharts of FIGS. 10 and 11 correspond to the block diagrams of FIGS. 8 and 9. This process is repeatedly executed while the engine 2 is not idling at a predetermined interval, which corresponds to the control cycle Δt in this embodiment.

First, the acceleration pedal depression degree ACCP, the engine speed NE, the fuel injection amount Q, the vehicle weight M, the shift position SFT, the vehicle speed SPD, the vehicle acceleration Vacc, the road inclination angle α, and the powertrain load torque TQv are read into a working storage of memory provided in the ECU 4 (S202) from sensors and processes.

Then, based on the acceleration pedal depression degree ACCP, the command torque TQaccp is computed by referring to the map MapTQaccp (S204).

At step 206, the engine friction torque TQd is computed based on the engine speed NE by referring to the map MapTQ.

At step 208, the auxiliary load torque TQg is computed based on the engine speed NE by referring to the map Maph in the same manner as the first embodiment.

As shown in the following expression 9, the auxiliary device load torque TQg is added to the engine friction torque TQd, and the resultant is set as the load torque TQa (S120).

$$TQa \leftarrow TQd + TQg \quad \text{[Expression 9]}$$

Next, the engine generated torque TQe is obtained based on the engine speed NE and the fuel injection amount Q by referring to a map MapE (S212). Then, as shown in the following expression 10, the load torque TQa and the powertrain load torque TQv are subtracted from the engine generated torque TQe, and the resultant is set as the torque difference DTQ (S214).

$$DTQ \leftarrow TQe - TQa - TQv \quad \text{[Expression 10]}$$

The estimated torque balance TQx is computed using the following expression 11 (S216).

$$TQx \leftarrow (DTQ + DTQold)/2 \quad \text{[Expression 11]}$$

The expression 11 is the same as the expression 4 of the first embodiment.

Then, the torque difference DTQ is set as the previous torque difference DTQold (218).

The engine speed change ΔNE is computed using the following expression 12 (S220).

$$\Delta NE \leftarrow NE - NEold \quad \text{[Expression 12]}$$

The expression 12 is the same as the expression 5 of the first embodiment.

Then, the moment of inertia Ix of the powertrain is computed by summing up the moment of inertia related to the weight obtained from the map Mapmst, and the moment of inertia related to the running resistance obtained from the map Mapspd (S222).

As shown in the expression 13, the moment of inertia Iae in the traveling state is obtained by adding the previously obtained moment of inertia Ie of the engine rotation system and the moment of inertia Ix of the powertrain.

$$Iae \leftarrow Ie + Ix \quad \text{[Expression 13]}$$

Then, the acceleration computation torque balance TQy is computed based on the moment of inertia Iae in the traveling state, the engine speed change ΔNE, the conversion factor K, and the control cycle Δt, using the following expression 14 (S226).

$$TQy \leftarrow Iae \times \Delta NE \times K/\Delta t \quad \text{[Expression 14]}$$

Then, the engine speed NE is set as the previous engine speed NEold (S228).

The estimated torque deviation TQc is computed using the following expression 15 (S230).

$$TQc \leftarrow TQx - TQy \quad \text{[Expression 15]}$$

Then, as shown in the expression 16, the traveling state demanded torque TQar is computed (S232).

$$TQar \leftarrow TQaccp + TQa + TQb + TQc \quad \text{[Expression 16]}$$

The throttle opening degree TA of the throttle valve 22, the injection amount Q of the fuel injection valves 12, and the ignition timing of the ignition plugs 10 are controlled such that the traveling state demanded torque TQar is realized (S234).

When the vehicle is driven by the engine power according to the above described process, even if an unexpected load (including a negative load) occurs, the torque is immediately reflected on the estimated torque deviation TQc. Therefore, the traveling state is maintained to correspond to the acceleration pedal depression degree ACCP, which stabilizes the traveling of the vehicle.

In the above described configuration, steps S210 to S218 of the output torque controlling process (FIGS. 10 and 11) correspond to first torque balance computation means, steps S220 to S228 correspond to the second torque balance computation means. Step S230 corresponds to torque balance deviation amount computation means, and step S232 corresponds to correction means.

The second embodiment as described above has the following advantages.

(A) When the engine 2 is not idling, torques acting to change the engine speed NE include the load torque of the powertrain in addition to the load torque of the engine friction and the load torque of the auxiliary devices.

Therefore, by taking the powertrain load torque TQv into consideration in addition to the engine friction torque TQd and the auxiliary device load torque TQg, an appropriate value of the estimated engine load torque TQz is always obtained even if the engine 2 is not idling. An appropriate value of the estimated torque balance TQx is therefore computed.

Also, by taking the moment of inertia Ie of the engine rotational system and the moment of inertia Ix of the powertrain into consideration, an appropriate value of the acceleration computation torque TQy is always obtained even if the engine 2 is not idling.

Therefore, if the estimated torque balance TQx and the acceleration computation torque balance TQy are different, the estimated torque deviation TQc is regarded to represent the deviation of the commanded torque TQaccp and the estimated engine load torque TQa from the actual engine load torque.

Therefore, by correcting the engine power based on the estimated torque deviation amount TQc (S232), the state of the engine power is shifted to a more appropriate state.

Also, since the engine power is corrected by the estimated torque deviation TQc, which has been obtained based on physical properties, the convergence property and the responsiveness do not need to be balanced through using a feedback gain even if the engine 2 is not idling. This permits the engine power to be highly responsive to load fluctuations.

In this manner, a high responsive engine power control is possible without performing modeling of the modern control.

(B) When the engine 2 is idling, the same advantages (A) to (E) as the first embodiment are obtained. Even if the engine 2 is not idling, the advantages (B) to (E) are obtained. Accordingly, the traveling of the vehicle is further stabilized.

The illustrated embodiments may be modified as follows.

(a) In the illustrated embodiments, the present invention is applied to a gasoline engine. However, the present invention may be applied to a diesel engine.

(b) In the illustrated embodiments, the idle speed is controlled by adjusting the fuel injection amount Q. However, the idle speed may be controlled by adjusting the opening degree of the throttle valve or an ISCV, which is arranged parallel to the throttle valve. When the idle speed is controlled by adjusting the intake air amount GA, a map having the engine speed NE and the intake air amount GA as parameters may be used as a map for obtaining the engine generated torque TQe.

(c) In the illustrated embodiments, the auxiliary devices include an air conditioner. However, the auxiliary devices may include other electrical loads such as headlights, and hydraulic loads such as a power steering.

Figure 12:
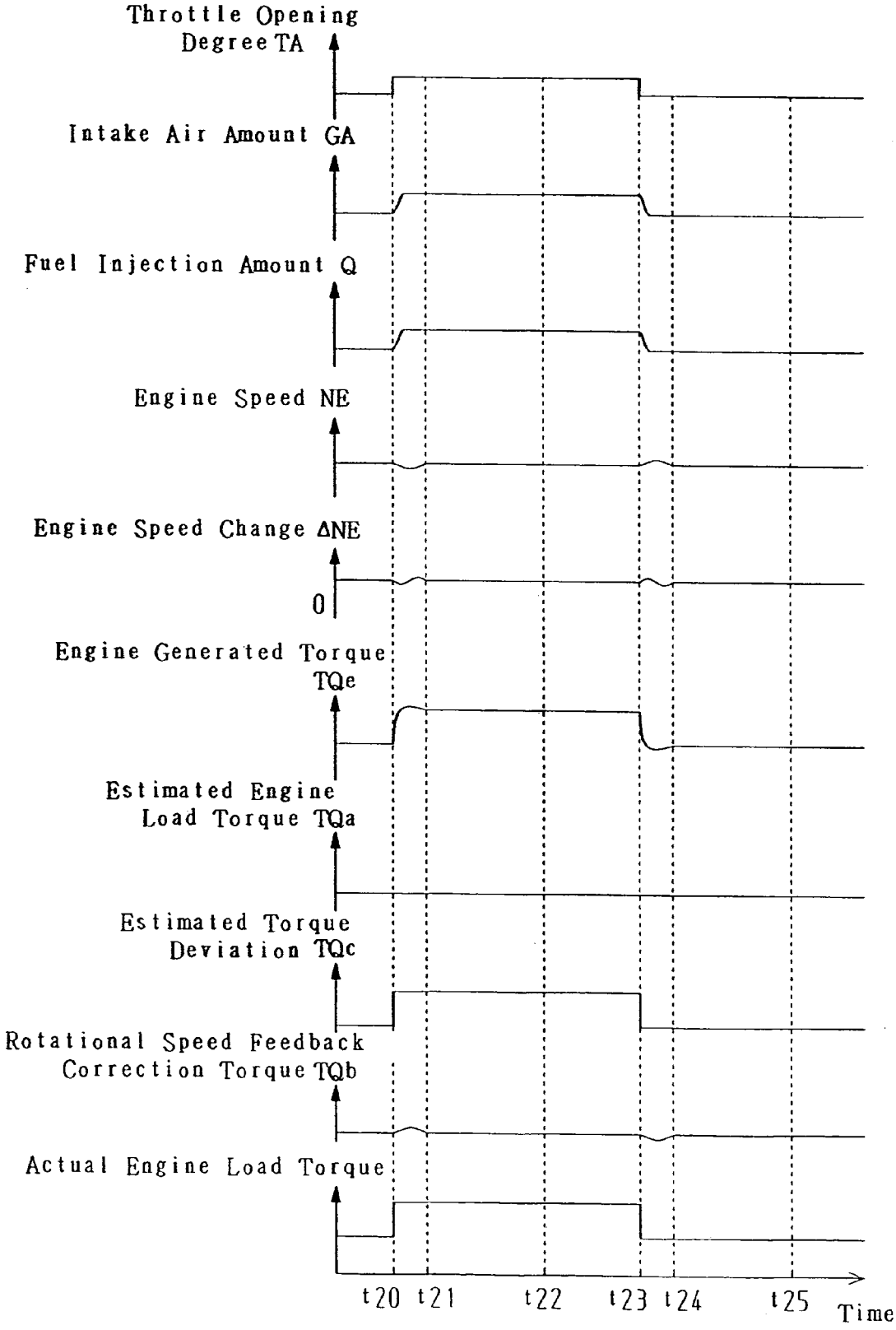
FIG. 12 is a timing chart showing another example of a control.

(d) In the example of FIG. 7 in the first embodiment, when the engine 2 is idling, the system sets the throttle opening degree TA to a degree that corresponds to the load of the idling state, and controls the engine generated torque TQe by adjusting the injection amount Q from the fuel injection valves 12. However, as shown in FIG. 12, the engine generated torque TQe may be controlled by adjusting the throttle opening degree TA. A period from t20 to t25 corresponds the period t10 to t15.

Figure 13:
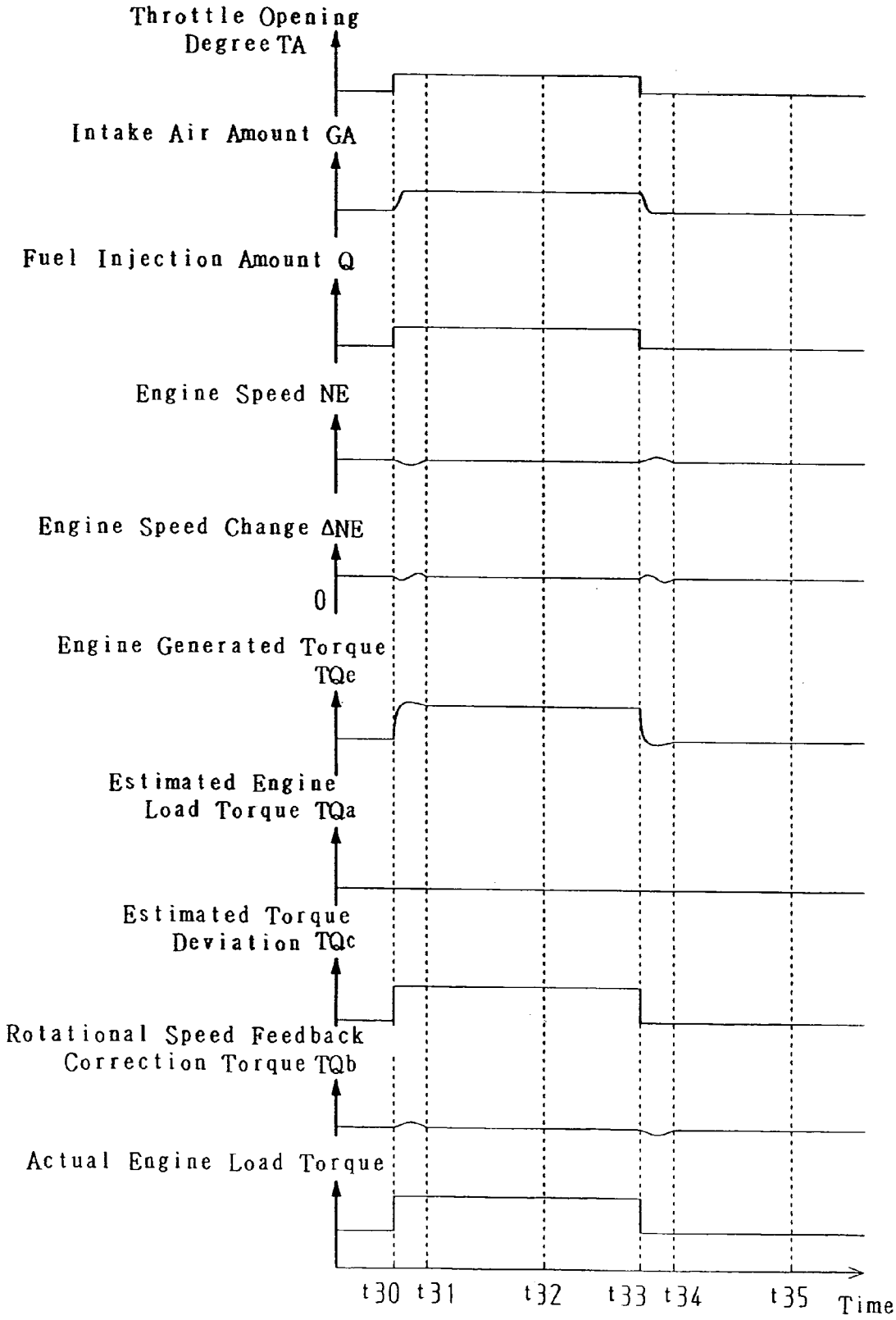
FIG. 13 is a timing chart showing another example of a control.

Alternatively, as shown in FIG. 13, the engine generated torque TQe may be controlled by adjusting the throttle opening degree TA and the fuel injection amount Q. A period from t30 to t35 corresponds the period t10 to t15.

The present examples and embodiments are to be considered as illustrative and not restrictive and the invention is not to be limited to the details given herein, but may be modified within the scope and equivalence of the appended claims.

The invention claimed is:

1. An apparatus for controlling power of an engine that is mounted on a vehicle having a powertrain coupled to the engine, the apparatus comprising:

a first computation section for computing a first torque balance that represents a difference between engine generated torque, which is torque generated by the engine, and estimated engine load torque, which is load torque applied to the engine;

a second computation section for computing a second torque balance that represents a change of the engine speed, wherein the second computation section computes the second torque balance based on the change of the engine speed over a predetermined period, the moment of inertia of the engine, and the moment of inertia of the powertrain;

a third computation section for computing a difference between the first torque balance and the second torque balance as a torque balance difference; and a correction section for correcting the engine power based on the torque balance difference.

2. The apparatus according to claim 1, wherein the first computation section obtains the engine generated torque based on a result of actual measurement by a torque sensor, combustion pressure of the engine detected by a combustion pressure sensor, or an operation condition of the engine.

3. The apparatus according to claim 1, wherein the vehicle has at least one auxiliary device driven by the engine, wherein, while the engine is idling, the first computation section obtains the estimated engine load torque based on engine friction torque and auxiliary device load torque, the engine friction torque being load torque applied to the engine due to friction produced in the engine, and the auxiliary device load torque being load torque applied to the engine by the auxiliary device.

4. The apparatus according to claim 1, wherein, while the engine is idling, the second computation section computes the second torque balance based on a change of the engine speed over a predetermined period and the moment of inertia of the engine.

5. The apparatus according to claim 4, wherein the first computation section obtains the difference between the engine generated torque and the estimated engine load torque before and after the predetermined period, and wherein the first computation section computes the mean value of the obtained two values as the first torque balance.

6. The apparatus according to claim 1, wherein, when the idle speed of the engine is controlled, the correction section corrects the engine power based on the torque balance difference.

7. The apparatus according to claim 6, wherein the vehicle has at least one auxiliary device driven by the engine, wherein, while the idle speed of the engine is controlled, the engine power is controlled based on engine friction torque and auxiliary device load torque that are generated when the engine is operating at a target idle speed, the engine friction torque being load torque applied to the engine due to friction produced in the engine, and the auxiliary device load torque being load torque applied to the engine by the auxiliary device.

8. The apparatus according to claim 1, wherein the vehicle has at least one auxiliary device driven by the engine, wherein the first computation section obtains the estimated engine load torque based on engine friction torque, auxiliary device load torque, and powertrain load torque, the engine friction torque being load torque applied to the engine due to friction produced in the engine, the auxiliary device load torque being load torque applied to the engine by the auxiliary device, and the powertrain load torque being load torque applied to the engine by the powertrain.

9. The apparatus according to claim 1, wherein the first computation section obtains the difference between the engine generated torque and the estimated engine load torque before and after the predetermined period, and wherein the first computation section computes the mean value of the obtained two values as the first torque balance.

10. A method for controlling power of an engine that is mounted on a vehicle having a powertrain coupled to the engine, the method comprising:

obtaining engine generated torque that is torque generated by the engine;

obtaining estimated engine load torque that is load torque applied to the engine;

computing a first torque balance that represents a difference between the engine generated torque and the estimated engine load torque;

computing a second torque balance that represents a change of the engine speed, wherein the second torque balance is computed based on the change of the engine speed over a predetermined period, the moment of inertia of the engine, and the moment of inertia of the powertrain;

computing a difference between the first torque balance and the second torque balance as a torque balance difference; and correcting the engine power based on the torque balance difference.

* * * * *